United States Patent [19]

McKenney

[11] Patent Number: 4,593,265

[45] Date of Patent: Jun. 3, 1986

[54] PORTABLE TRAFFIC CONTROL APPARATUS

[75] Inventor: John D. McKenney, South Laguna, Calif.

[73] Assignee: Lear Siegler, Inc., Santa Monica, Calif.

[21] Appl. No.: 539,137

[22] Filed: Oct. 5, 1983

[51] Int. Cl.[4] ..... B60Q 1/24

[52] U.S. Cl. ..... 340/114 B; 340/109; 340/119; 40/550; 40/590; 280/33.99 T

[58] Field of Search ..... 40/550, 590, 612; 340/109, 114 B, 908, 84, 87, 90; 116/63 R, 63 P; 280/33.99 T; 248/122, 125, 284; 182/68

[56] References Cited

U.S. PATENT DOCUMENTS

| | | | |
|---|---|---|---|
| D. 234,754 | 4/1975 | Hall, Jr. | D10/114 |
| 547,077 | 10/1895 | Iske et al. . | |
| 1,162,413 | 11/1915 | Sperling . | |
| 2,365,176 | 12/1944 | Curtis | 248/125 |
| 2,815,132 | 12/1957 | Stone | 414/11 |
| 2,865,634 | 12/1958 | Townsend | 248/284 |
| 2,964,122 | 12/1960 | Funk et al. | 182/180 |
| 3,515,243 | 6/1970 | Ellen, Jr. | 182/68 |
| 3,520,273 | 7/1970 | Daifotes | 340/87 |
| 3,622,980 | 11/1971 | Elledge, Jr. | 340/82 |
| 3,883,846 | 5/1975 | Bruner | 340/109 |
| 3,886,519 | 5/1975 | Hovland | 340/135 |
| 4,077,144 | 3/1978 | Smits | 340/87 |
| 4,087,785 | 5/1978 | Dodich | 340/114 B |
| 4,259,660 | 3/1981 | Oliver | 340/87 X |

OTHER PUBLICATIONS

Lear Siegler literature on "Traffic Controller" dated 2/81.

Over-Lowe Literature on "Traffic Warning Boards" (undated).

Bemis & Sons, Inc. Literature on "Flashing Arrows" (undated).

Dietz Co., drawing on "Arrowboard"-undated.

Amida literature on "Detour-Lite" undated.

Terrain King Corporation literature on "Flagman"-undated, Hi-Vu, Inc. literature on "Lane Makers"-undated.

*Primary Examiner*—James L. Rowland

*Assistant Examiner*—Brian R. Tumm

*Attorney, Agent, or Firm*—Edward J. DaRin

[57] ABSTRACT

Traffic control apparatus of the wheeled trailer type having pairs of links for selectively and uniformly moving a traffic control message panel between a substantially vertical display position and a substantially horizontal storage/transit position. Three pairs of links are controlled by a winch-cable system coupled thereto to control the pivoting movements of the pairs of links to cause the smooth movement of the traffic control message panel between positions. The pivot points for the pairs of linkages are preselected to minimize the tension on the winch cable during the panel movements between positions.

26 Claims, 12 Drawing Figures

FIG. 11.
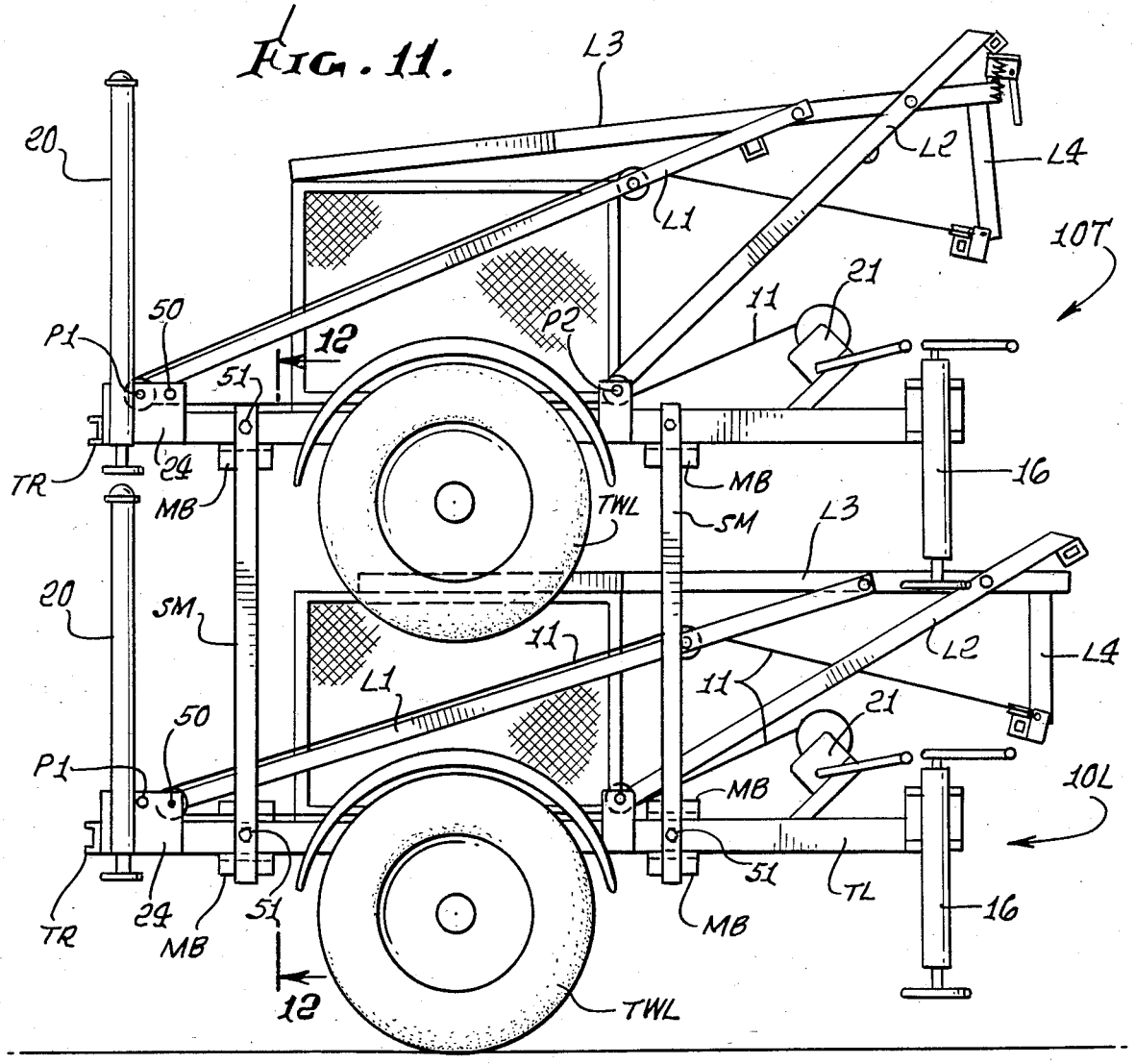
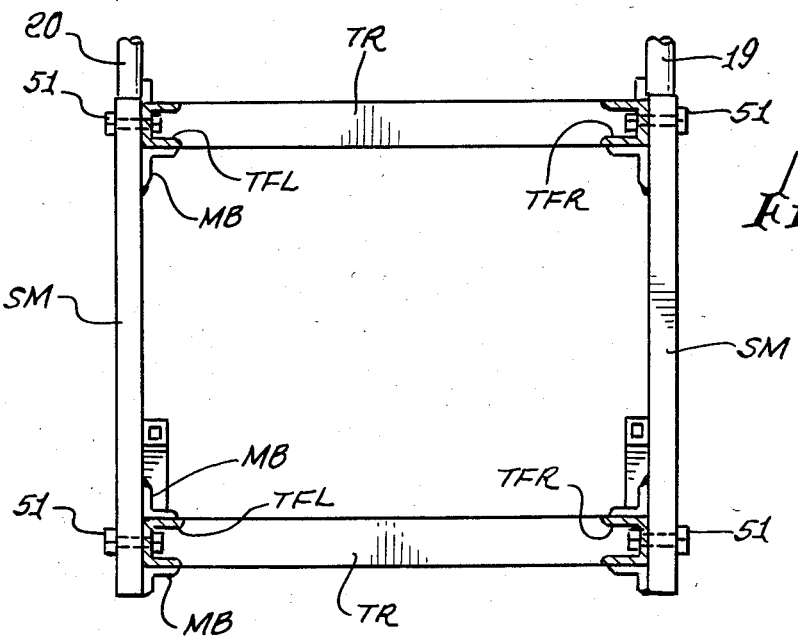
FIG. 12.

PORTABLE TRAFFIC CONTROL APPARATUS

FIELD OF INVENTION

This invention relates to traffic control apparatus and more particularly to improved portable traffic control apparatus of the wheeled trailer type having an electrically controllable arrow display panel mounted thereon and adapted to be movable between a display position and a storage position for transit when the trailer is hauled.

BACKGROUND OF INVENTION

Portable traffic control apparatus of the trailer type having an arrow display panel thereon is well known in the art. These traffic control devices are trailer mounted, self-powered devices that may be moved from location to location for signalling traffic. These types of traffic controllers are usually used for warning as to hazardous construction areas or maintenance zones, or in high density or high speed traffic zones, to give the drivers of motor vehicles approaching such areas or zones advance warning thereof. The traffic controller is mounted at a sufficient height from the road surface to be clearly visible to an approaching driver of a motor vehicle and sufficiently in advance of the traffic condition to be avoided to permit the driver to assimilate the directions signalled by the traffic arrow panel so that the driver can take the necessary corrective action in sufficient time to avoid the undesirable traffic condition. These types of devices are known in the art as advance warning flashing arrow panels and must conform to the requirements of Part 6E-7, "Advance Warning Flashing Arrow Panels", of the Federal Highway Administration's Manual of Uniform Traffic Control Devices.

Most the the present day advance warning trailer mounted traffic control apparatus is basically similar in design. Basically, all of the trailer mounted prior art advance warning traffic control apparatus have a very large arrow panel for providing traffic control direction by means of electrical lights that are controlled to define various traffic control directions, such as, for example, a flashing directional arrow. The trailer mounted display panels range in size from 48 inches by 96 inches, and 36 inches by 72 inches, and weigh on the order of 150 pounds. All of the prior art apparatus has some means for moving these heavy panels between a display position for traffic control and a storage position for transit to permit the trailer to be readily transported to a new location requiring traffic control. Typical prior art traffic control apparatus are disclosed in U.S. Pat. Nos. 3,622,980; 3,886,519; 4,077,144; 4,087,785 and Des. 234,754.

These prior art devices for controlling the positions of the traffic control display panels include winch and cable assemblies, telescoping and rotating tube type masts, hydraulic lifting mechanisms, or the like. In addition, lifting and lowering devices for other purposes are exemplified by U.S. Pat. Nos. 2,815,132; 2,964,122; 3,545,243; 1,162,413 and 547,077. None of these prior art mechanisms for moving a traffic control display panel between a display position and a storage position for transit is completely satisfactory. In addition to the problems associated with the actual use of the trailer mounted traffic control apparatus, the heavy trailer mounted traffic control apparatus are expensive to ship from the point of manufacture to the ultimate user because they are large, bulky, heavy and difficult to handle. In one particular prior art trailer mounted traffic control apparatus, in order to reduce the expense of shipment of such trailers, a technique was devised to permit the stacking of a pair of trailers, one on top of another, to increase or double the number of trailers that could be shipped in a truck trailer or similar shipping compartment. In order to stack the trailers in this fashion, it was necessary to remove the traffic arrow panel from the trailer from the supporting structure and then diassemble the structural components for mounting the traffic control arrow panel in a traffic display position in preparation for stacking of the trailers. Once the traffic control trailers are disassembled in this fashion, they can be stacked one on top of another. The disassembled structural components can then be stacked and secured together on the topmost stacked trailer. The traffic message panel is also removed and is shipped in a separate cardboard carton for protective purposes. Upon receipt of the stacked trailers at the point of destination, it was necessary to unstack the trailers and reassemble the structural components on the trailer in preparation for mounting the arrow panel. One of the most difficult tasks with such a prior art trailer mounted traffic control apparatus was to secure the message panel in the display position, since the panel weighs about 150 pounds, they had to be hoisted by two persons about 8 feet above the supporting surface in order to render the trailer usable. Accordingly, there is a present need for a portable traffic control device of the trailer mounted type having an improved lifting and lowering apparatus that can be readily operated for lifting the traffic arrow panel to a preselected display position and lowering the traffic arrow panel to a storage position for local transit. In addition, the improved trailer mounted traffic control apparatus should be designed to permit double stacking of trailers without requiring dismantling of the lifting/lowering control linkage for the display panel, prior to stacking, for shipping the trailers from the manufacturing site.

SUMMARY OF THE INVENTION

The present invention provides an improved, low profile portable traffic control apparatus of the type that mounts a traffic control arrow panel that is movable between a preselected vertical display position and a preselected, substantially horizontal storage position for local transit. The improved apparatus comprises an improved bar linkage system readily operable through a winch-cable system for uniformly raising the arrow panel to a display position and uniformly lowering the panel to a storage position on the trailer, and which apparatus is lower in cost to manufacture than the known prior art devices. The position of the arrow panel on the trailer for storage purposes is at a lower position than prior art devices so as to have a lower center of gravity than all presently known similar traffic control devices, and also results in reduced wind resistance when towing the trailer. The linkage system of the present invention comprises four pairs of bar linkage means that have been designed with pivot points for the linkages located for minimizing the tension on the winch cable for raising and lowering the traffic arrow panel. The use of pairs of linkages that are secured together characterize the linkages as having much improved lateral, side to side, stiffness. The improved lifting and lowering of the linkage system also permits the trailers to be double stacked for long distance shipment without the need for dismantling any of the linkage system, thereby eliminating the reassembly operations at the point of use. In accordance with the present invention, the traffic arrow panel only need be removed from the trailer for separate shipment and, because of the low profile of the lifting mechanism when in transit/storage position, the traffic control panel can be readily assembled and disassembled at the storage position for the panels on the trailer.

From a broad structural standpoint, the present invention comprehends a traffic controller comprising a supporting frame structure with dual, symmetrically arranged linkage means pivotally secured to the frame structure for movment relative to the supporting frame structure. The traffic controller includes arrow display means secured to the linkage means so as to be responsive to the movements thereof to move between substantially vertical and substantially horizontal positions. The traffic controller includes control means coupled to the linkage means for uniformly moving the linkage means to selectively move the arrow display means between the horizontal and vertical positions and maintain the display means in a preselected position. The traffic controller may further include compression spring means carried by the linkage means to engage the linkage means so as to be compressively seated thereto when the linkage means are moved to place the display means in a preselected display position at or adjacent the vertical position. The compression spring means automatically functions to move the display means a preselected distance downwardly away from the preselected display position prior to when the linkage means are controllably moved away from the selected display position to a lowered position.

From a specific structural standpoint the present invention comprehends a supporting frame structure of the wheeled trailer type. A plurality of pairs of bar linkage means are pivotally secured to the supporting frame structure for movement relative to the supporting frame. The plurality of pairs of bar linkage means comprise a first pair of bar linkage means symmetrically arranged at opposite sides of the supporting frame and each being pivotally secured to the frame adjacent one end thereof to move in unison in response to a pivoting force being imparted thereto. A second pair of bar linkage means is symmetrically arranged on opposite sides of the supporting frame and each is pivotally secured to the frame adjacent one end thereof and at a preselected location spaced from the first pair of bar linkage means to move in unison in response to a pivoting force being imparted thereto. A third pair of bar linkage means is symmetrically arranged with said first and second pairs of bar linkage means and is pivotally secured to each of the first and second pairs of linkage means adjacent one end thereof to be pivoted in unison in response to the pivoting forces imparted to the first and second pair of linkage means. A traffic control display apparatus is secured to the other end of the third pair of bar linkage means to be moved in unison therewith. The third pair of bar linkage means includes a cross member pivotally secured adjacent one end thereof. A controllable winch-cable system is provided and is secured to the frame. The winch-cable is coupled from the winch to a plurality of pairs of bar linkage means for imparting a pivoting force thereto by means of pulley means in response to the alternate rotations of the winch, causing the shortening and lengthening of the length of the cable paid out from the winch to uniformly move the traffic control display apparatus between a substantially vertical display position and a substantially horizontal storage/transit position. The winch-cable system includes a plurality of pulleys spaced on the bar linkage means having a first rotatable pulley secured adjacent the pivot point for the second pair of bar linkage means on the same side of the frame as the winch-cable system for conveying the cable to and from the winch. A second rotatable pulley is secured adjacent the pivot point for the first pair of bar linkage means on the same side of the frame as the first pulley for conveying the cable to and from said first rotatable pulley. A third rotatable pulley is provided and secured to the first pair of bar linkage means at a preselected spaced location on one of the bars of the first pair of linkage means from said second pulley and on the same side of the frame as the second pulley to convey the cable to and from the second pulley. A pair of rotatable pulleys are rotatably secured adjacent each end of the cross member for the third bar linkage means to move in unison therewith. One of the pair of rotatable pulleys on the cross member is positioned to convey the cable to and from the third rotatable pulley and to and from the other pulley on the cross member. The cable is conveyed from said other pulley on the cross member so as to be fixedly secured to the other one of the bars of the first pair of linkage means on the opposite side of the frame. The operation of the winch-cable system controls the length of the cable extending from the winch and causes the responsive rotation of the aforementioned cross member to thereby minimize the loading stress at said first pair of pulleys on the cross member during the operation of the winch-cable system.

BRIEF DESCRIPTION OF THE DRAWINGS

These and other features of the present invention may be more fully appreciated when considered in the light of the following specification and drawings, in which:

FIG. 11 is a left side elevational view of a pair of trailer mounted traffic control apparatus with the traffic message panels and yokes removed, illustrating the stacked relationship thereof prior to placement in a container for shipment; and FIG. 12 is a view taken along the line 12—12 of FIG. 11.

DETAILED DESCRIPTION OF THE INVENTION

Figure 1:
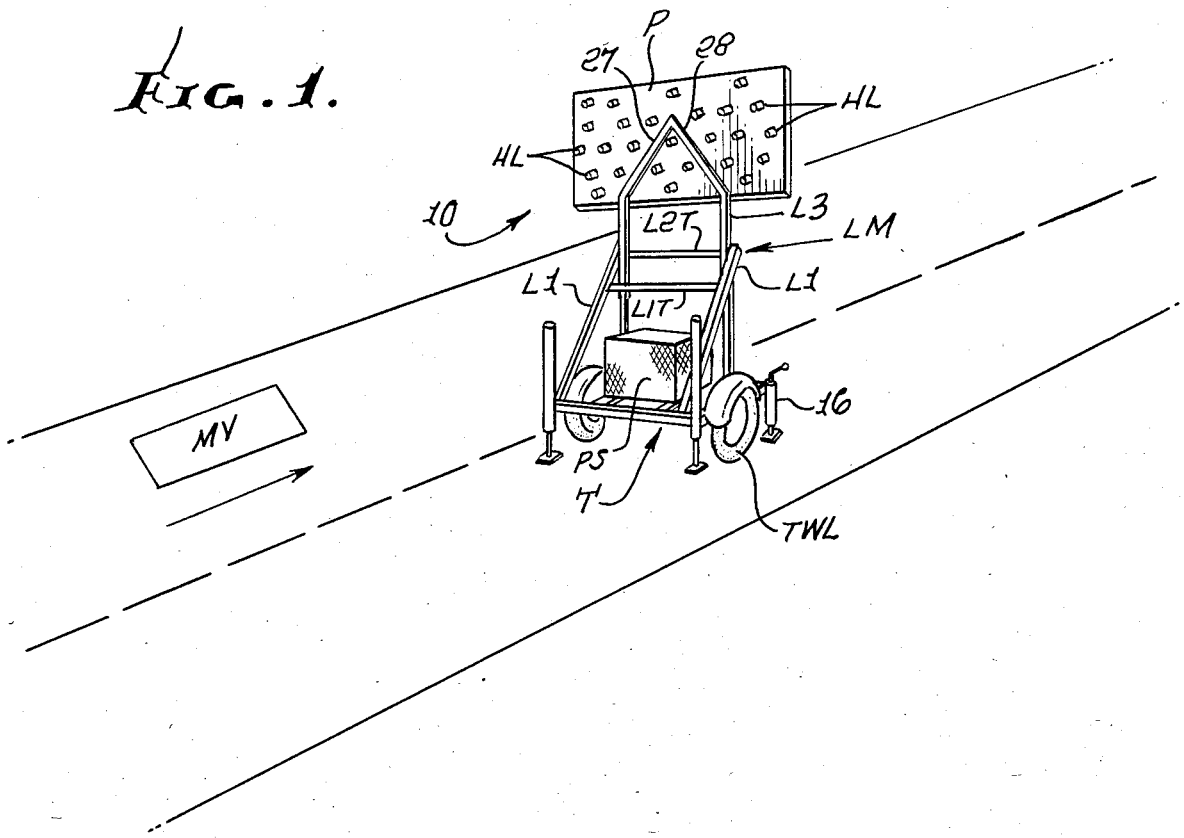
FIG. 1 is a diagrammatic representation of a motor vehicle traveling on a public highway illustrating the trailer mounted traffic control apparatus embodying the present invention positioned on the highway for traffic control purposes.

Now referring to the drawings, the traffic control apparatus 10 of the present invention will be described in detail. The trailer mounted traffic control apparatus 10 is illustrated in FIG. 1 as it may be employed for giving advance warning to motorists traveling on the highway. The traffic control arrow panel is conventionally defined to electrically illuminate right or left flashing arrows, sequential stem arrows, double arrows, sequential chevron and caution displays. These electrically defined displays are to instruct the oncoming drivers of motor vehicles that a hazardous construction or maintenance zone is upstream of the traffic control apparatus 10 and that the driver of the motor vehicle should heed the traffic control direction displayed by the apparatus so as to safely pass or avoid the hazardous construction or maintenance zone when he arrives at that location.

Figure 2:
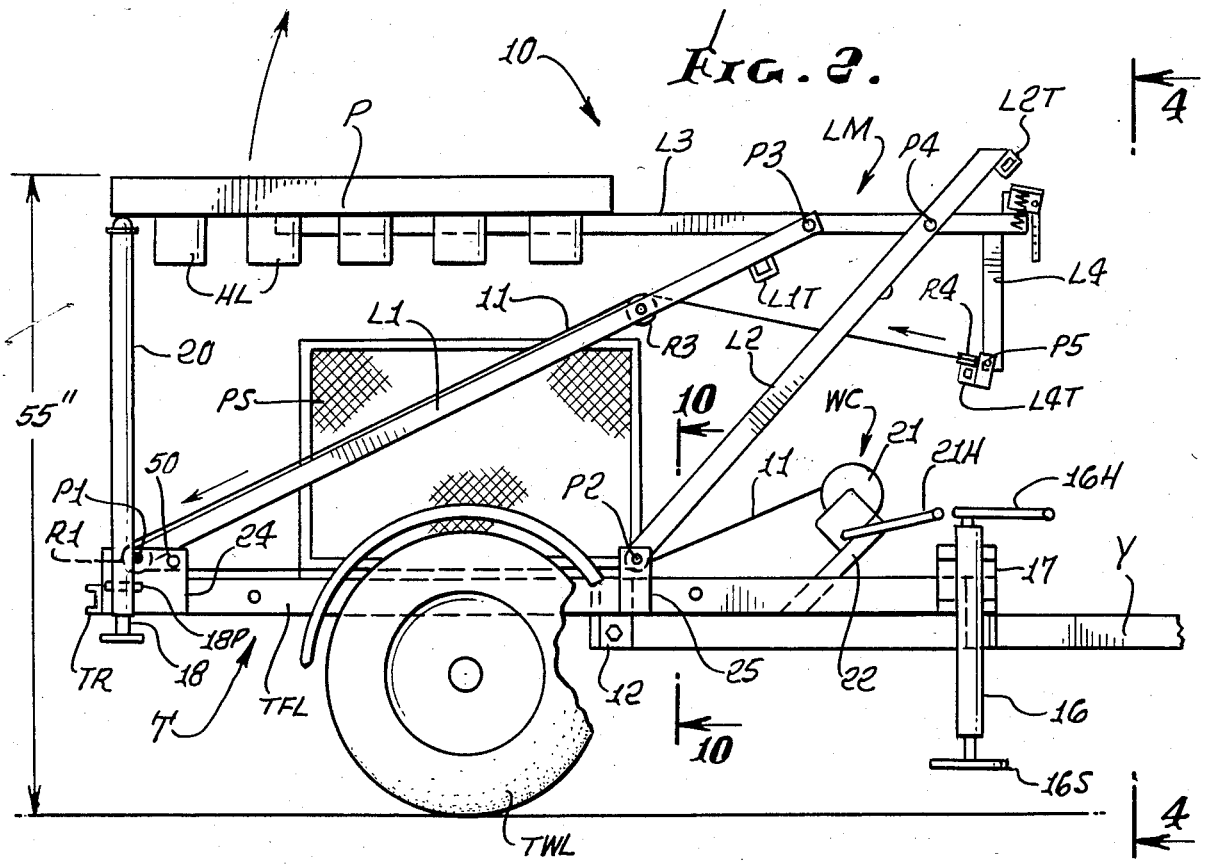
FIG. 2 is a left side elevational view of the portable traffic control apparatus illustrating the traffic message panel in a storage/transit position.
Figure 3:
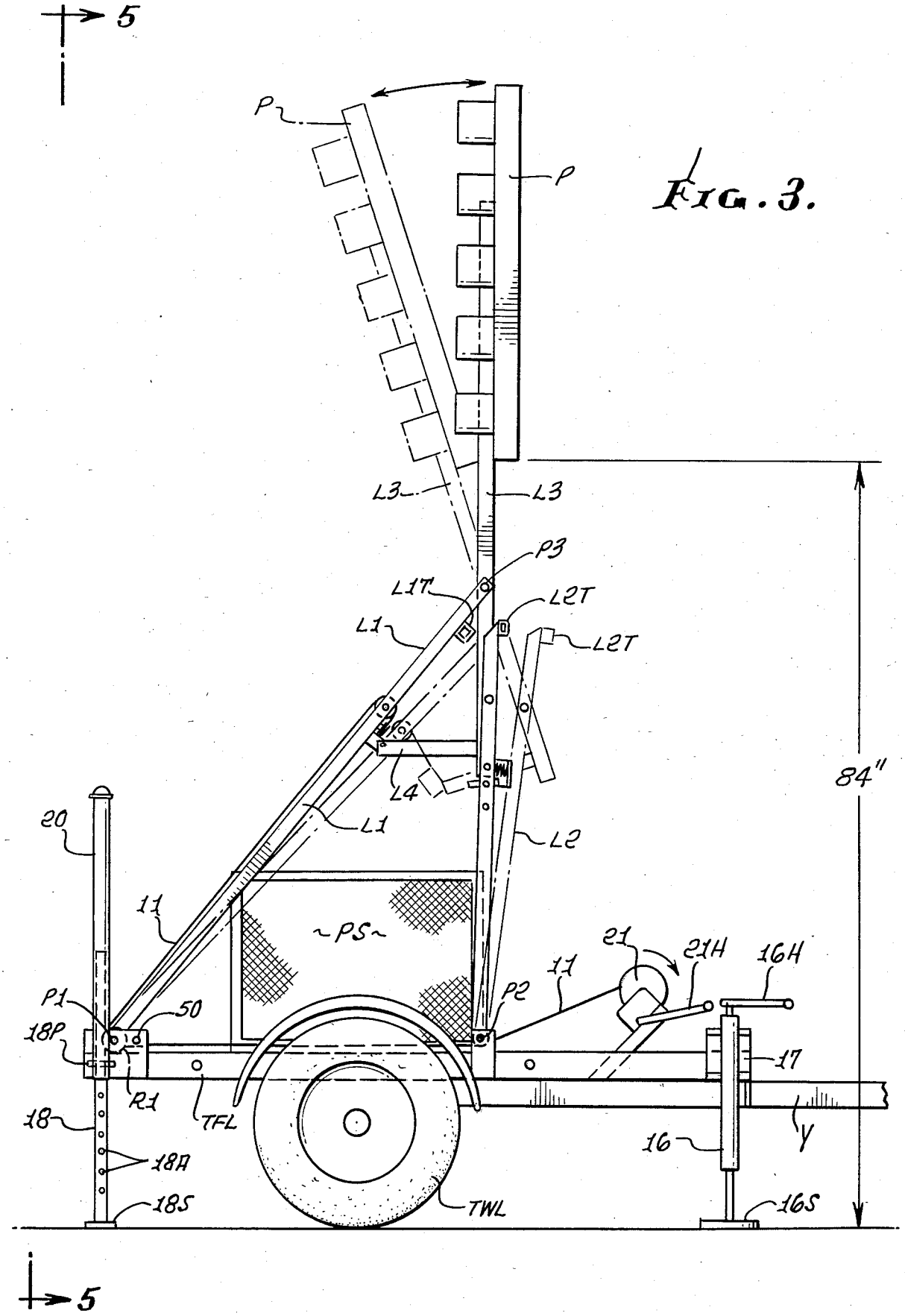
FIG. 3 is a left side elevational view of the traffic control apparatus showing the traffic message panel in its fully vertical position with the alternate position of the panel and the corresponding positions of the linkage means illustrated in dotted outline.

The portable control apparatus 10 basically includes a supporting frame structure T illustrated as being of the wheeled trailer type. A message display panel P, of conventional construction, is provided with a plurality of spaced apart, hooded electrical lamps HL mounted thereon for displaying various traffic control messages by selectively controlling the energization and de-energization of the lamps. The control apparatus for controlling the energization of the lamps is not under consideration herein since it is not a part of the present invention. The electrical power source for the electrical lamps is shown within the enclosed cage, identified as cage PS, which may include diesel or gasoline powered units associated with alternators or electric storage batteries for energizing the panel lights HL. The panel P is secured to a lifting/lowering linkage means LM pivotally secured to supporting frame T and controlled through a winch-cable system WC coupled to the linkage means LM. The alternate rotation of the winch-cable system WC controls the payout and winding up of the cable 11 to correspondingly pivot the linkage means LM and thereby lower the panel P to a storage position, such as illustrated in FIG. 2, or raise it to a display position, such as illustrated in FIG. 3. The supporting frame T includes a yoke Y adapted to mount a trailer hitch (not shown) at its free end to permit the traffic control apparatus 10 to be readily towed from job site to job site.

Figure 4:
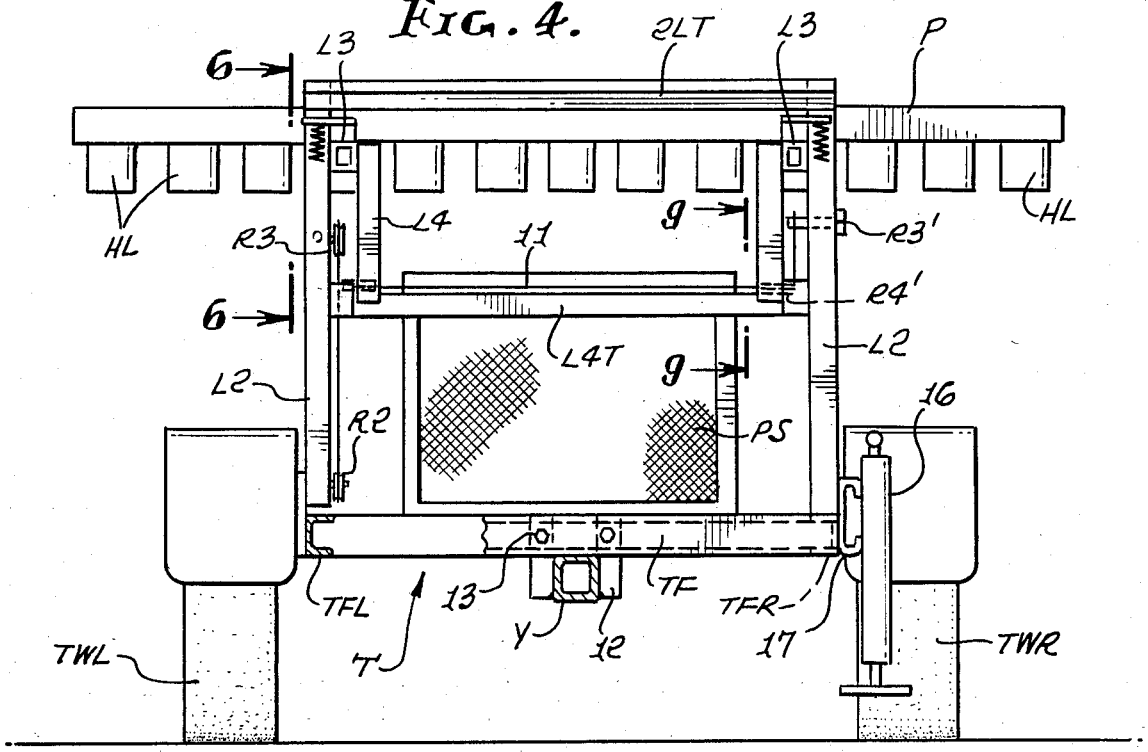
FIG. 4 is a front elevational view, with a portion broken away, taken along the line 4—4 of FIG. 2.

The trailer frame structure T is symmetrically defined with a pair of longitudinally extending U-shaped structural members TFL and TFR secured at their ends by a U-shaped cross member TF at the front end of the trailer and a U-shaped cross member TR at the rear end of the trailer. These structural members may be readily secured together by welding or any other suitable fastening means. A pair of structural members is secured transverse of the longitudinal members TL and TR, and intermediate the members TF and TR along with a rigid supporting plate for mounting the power source unit PS, as illustrated. A pair of trailer wheel assemblies is symmetrically arranged on opposite sides of and intermediate the ends of the members TL and TR in a conventional fashion to permit the trailer frame T to be readily wheeled. The left hand wheel assembly is identified as TWL, while the right hand wheel assembly is identified as TWR. The yoke Y comprises a square tubular member carried by the trailer frame structure T by means of a bracket 12 secured to the front cross member TF by suitable fasteners 13 to extend forwardly thereof; see FIG. 4. The opposite end of the yoke member Y is secured to the front intermediate cross member by a bracket 14. The bracket 14 is similar to the bracket 12 and is secured to the yoke element Y by fasteners 15; see FIG. 5. The free end of the yoke member Y or the front end of the member may be provided with any conventional means for hitching to a towing motor vehicle. The yoke member Y, when secured to the frame structure T in this manner, can be secured to the frame structure T at the point of use, i.e., after shipment from the point of manufacture.

Figure 5:
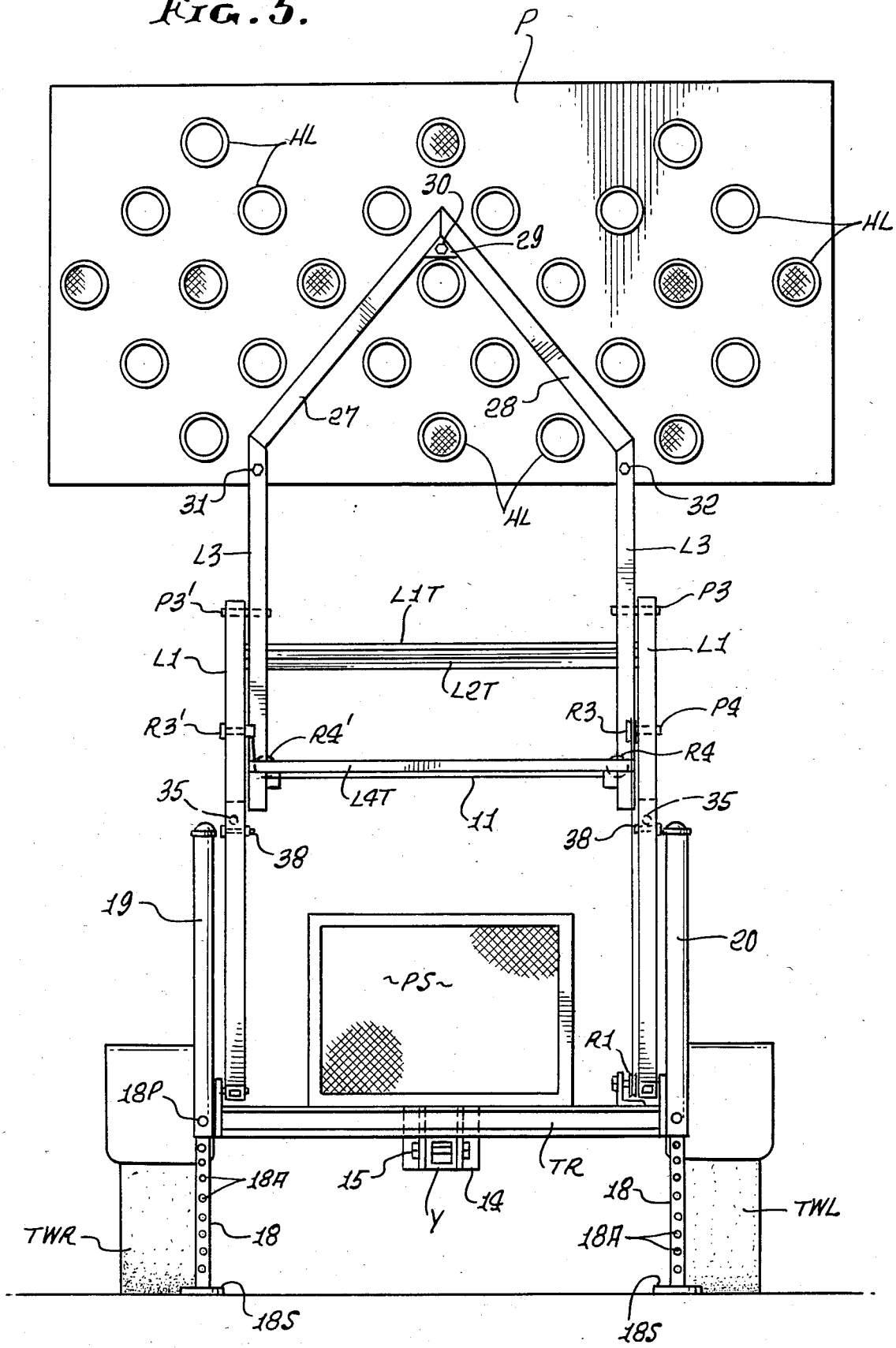
FIG. 5 is a rear elevational view taken along the line 5—5 of FIG. 3.

The trailer frame structure T is stabilized by means of individual stabilizing elements secured adjacent each corner of the frame structure T. The front end of the frame structure T is stabilized by conventional stabilizing jacks 16 secured adjacent each corner of the front end of the frame structure by means of C-shaped brackets 17 suitably secured to the frame structure T. The stabilizing jack 16 is normally operated by a handle 16H to control the position of the jack supporting member 16S between a stabilizing position engaging the trailer supporting surface or the ground (see FIG. 3) and a transit position spaced upwardly of the ground; see FIGS. 2 and 4. The rear frame structure T is stabilized by stabilizing members 18 secured adjacent each rear corner of the frame structure T, as best illustrated in FIG. 5. Stabilizing members 18 are constructed and defined to be telescoped within the panel arresting and supporting members 19 and 20 secured to the trailer frame structure T to extend upwardly therefrom. The panel supporting members 19 and 20 are defined to extend upwardly a preselected distance to arrest the downward travel of the panel P and to support the top edge of the panel thereof for transit purposes, as illustrated in FIG. 2. The stabilizing members 18 are slidably received within the corresponding panel supporting members 19 and 20 in a telescoping relationship and may be secured in a selected position relative to the supporting surface by the provision of a plurality of spaced apertures 18A coaxial with apertures for the members 19 and 20 to allow it to be secured to the arms 19 and 20 by means of a locking pin 18P secured in the coaxial apertures. In this manner the arms 18 may be secured in the transit position, spaced from the supporting surface, as illustrated in FIG. 2, or in a stabilizing position with the supporting plates 18S mounted in engagement with the supporting surface, as illustrated in FIGS. 3 and 5.

The winch 21 of the winch cable system WC is secured to the trailer frame structure T on one side thereof and forward of the wheel assemblies TWL and TWR. The winch 21 is a manually operated winch and is provided with an operating handle 21H for rotating the winch, either clockwise or counterclockwise, to control the winch cable 11. The winch 21 is secured to a mounting element 22 that is angularly secured to the left side of the trailer member TL on the inside surface thereof, as best illustrated in FIGS. 2 and 3. The mounting element 22 is secured at a preselected position rearwardly of the front structural cross member TFL and forward of the trailer wheels TWL by cantilevering it from the member TFL at approximately a 45 degree angle. The winch 21 is secured adjacent the end of the member 22 to allow the operating handle 21H to be rotated without interference with any of the frame members or supporting members. The cable 11 has one end secured to the winch 21 and the rotation of the operating handle 21H controls the payout and winding up of the cable relative to the winch 21. The winch 21 is of a conventional commercial construction.

The linkage means LM comprises a dual, four bar, rigid linkage system controlled by the winch cable system WC to pivot the individual links of the linkage means LM. The linkage means LM are secured to the symmetrically constructed and defined trailer frame structure T. The length of the trailer frame T, without the yoke Y, fixes one link length of the four bar linkage system. This pair of links is identified as the pair of longitudinally extending frame members TFL and TFR. This pair of link members is stationary, while the other three pairs are controllably moved for raising and lowering the display panel P.

The movable pairs of linkages are symmetrically defined on opposite sides of the trailer frame structure T and secured together to move in unison. Each of the movable pairs of linkages is preferably constructed of square tubing elements for ease of construction and manufacture. The first pair of movable links is the pair of rigid bars L1, each having one end pivotally secured to the trailer frame structure T adjacent the rear end thereof. An upstanding mounting plate 24 is secured to the trailer frame structure adjacent the rear end thereof and is provided to extend above the frame members TFL and TFR a oreselected distance. The plates 24 are adapted to receive fasteners functioning as pivot points that are identified as the points P1 on the opposite sides of the frame structure T. The first pair of linkages also includes a cross member that is constructed of square tubing. The cross member is identifed as the member L1T and is secured in a preselected, spaced relationship from the free end of the links L1, as illusrated in FIG. 2, for example. With the pair of rigid link members L1 secured by the transverse member L1T, the pair of linkages will then move in unison when they are pivoted about the pivot points P1.

A second pair of rigid link members, identified as the members L2, are also pivotally secured to the trailer frame structure T by means of mounting plates 25 secured to the opposite side of the frame members TFL and TFR a preselected distance forward of the plates 24. The plates 25 are apertured to receive a fastener that is longitudinally aligned with the pivot points P1 to extend in the same horizontal plane and are identified as the pivot points P2. The mounting plates 25 are secured to the trailer frame structure T at a point immediately adjacent the fenders of the wheel assemblies TWL and TWR, as viewed in FIGS. 2 and 3. The second pair of linkages L2 also includes a cross member secured at the ends thereof and is identified as the member L2T. The cross member L2T is also constructed of square tubing and is welded to the ends of the link members L2 so that the second pair of linkages will move in unison when pivoted about the points P2.

The third pair of movable rigid linkages is identified as the linkages L3 which are pivotally secured adjacent the free ends of the pairs of linkages L1 and L2. As best illustrated in FIG. 5, the top ends of the pair of linkages L3 are releasably secured to the traffic control message panel P. For this purpose the ends of the linkages L3 are secured by welding or the like to two panel mounting bars 27 and 28 arranged in the form of an inverted "V" and secured to one another. A panel mounting plate 29 is secured at the apex of the "V" for the mounting bars 27 and 28 and is apertured to receive a bolt 30 that extends through a corresponding aperture in the panel P and is secured thereto by means of a nut (not shown). The bars 27 and 28 are mounted flush with the face of the panel P and extend between the hooded lamps HL. The bar links L3 are similarly secured by means of bolts 31 and 32 that extend through the panel P and are secured thereto by nuts; see FIG. 5.

Figure 6:
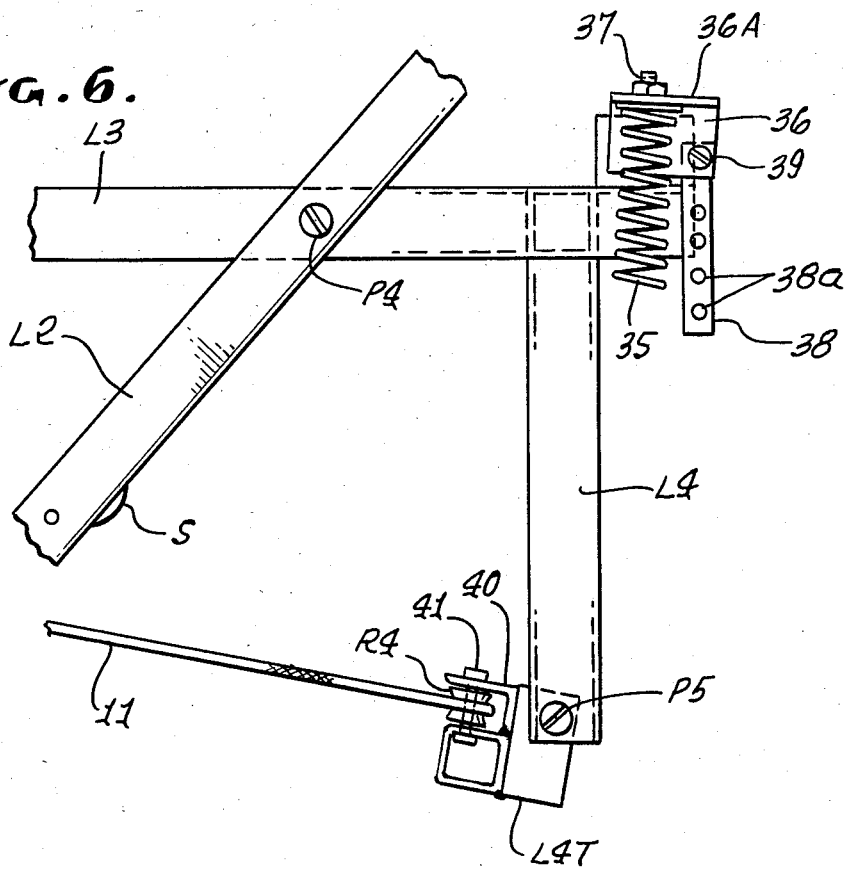
FIG. 6 is a partial, enlarged view of the linkage mechanism corresponding to the position of the traffic message panel as illustrated in FIG. 2.
Figure 7:
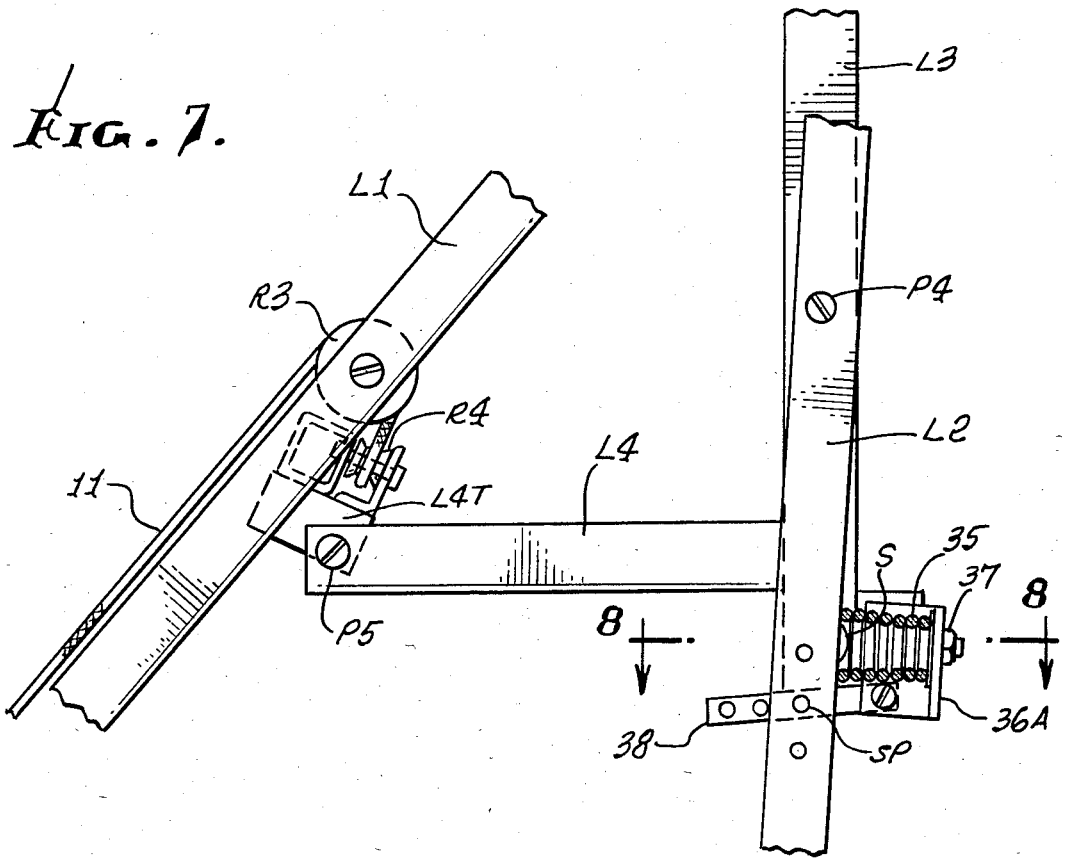
FIG. 7 is a partial, enlarged view of the linkage mechanism corresponding to the position of the traffic message panel as illustrated in FIG. 3.
Figure 8:
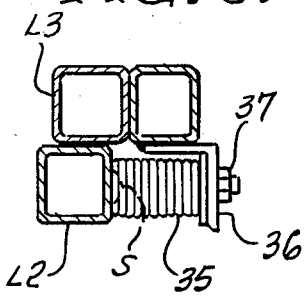
FIG. 8 is a cross sectional view taken along the line 8—8 of FIG. 7.

The pair of bar links L1 are each pivotally secured by means of suitable fasteners a preselected distance from the ends of the links L3, the ends opposite the ends mounting the panel P. The fasteners that pivotally secure the links L1 and L3 together are identified as the pivot points P3. The second pair of links L2 are each pivotally secured to the links L3 at a preselected point spaced intermediate the pivot points P3 and the free ends of the links L3; see FIG. 2. With this arrangement, the pair of links L3 will also move in unison when they are pivoted in response to the pivoting action imparted to the pair of links L1 and L2. The pair of rigid link members L3 also include a pair of cross members that are identified as the members L4. The members L4 are secured a preselected distance inwardly of the free ends of each of the links L3 and outwardly of the pivot points P4. The cross members L4 may also be constructed of square tubing and pivotally mount a transverse member L4T pivotally secured at each end of the cross members L4. The members L4 are secured to the arms L3 in a transverse relationship with the cross member L4T pivotally secured adjacent the inside corner of the free ends of the members L4, as illustrated in FIGS. 2 and 6, for example. The points at which the cross member L4T is pivoted to the members L4 is identified as the pivot points P5. The cross member L4T mounts a pulley at each end for coupling the cable 11 of the winch cable system WC as will be explained more fully hereinafter. The free ends of the rigid link members L3 also secure a pair of compression springs 35. The compression springs 35 are mounted by means of L shaped brackets 36 that are secured to the ends of the link members L3, as best illustrated in FIG. 6. Each end of the compression springs 35 are seated to the outwardly extending arm 36A for the bracket 36 by means of a fastener 37. The opposite end of the compression springs 35 are freely suspended from the bracket 36. The bracket 36 also pivotally secures a latching bar 38 that is secured adjacent the bottom end thereof as viewed in FIG. 6, by means of a fastener 39. The latching bar 38 is provided with a plurality of latching apertures **38*a* that are spaced a preselected distance from one another. The apertures 38*a* may be spaced to position the panel P in a vertical position in ten degree increments downwardly therefrom. Accordingly, the compression springs and the latching bar 38 move in unison with the pivoting action imparted to the links L3. For the purpose of seating the free ends of the compression springs 35 the link members L2 are provided with a seat S defined on the links L2. The seats S may be the semicircular head of a conventional bolt that is secured to the links L2 and are arranged at preselected distances downwardly from the pivot point P4, as best seen in FIG. 6. The free ends of the compression springs 35 then would be seated against the links L2 and seated around the seats S, such as illustrated in FIGS. 7 and 8**, when the linkage means LM has positioned the display panel P in a preselected display position.

Figure 9:
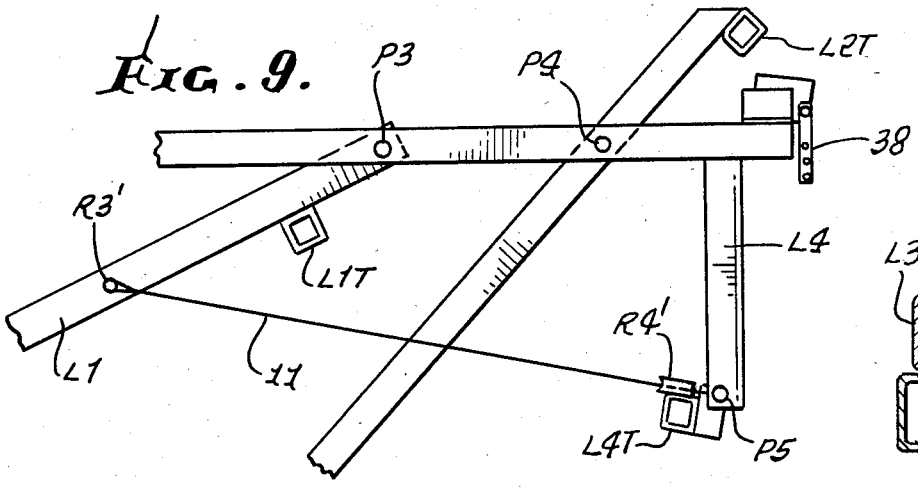
FIG. 9 is a partial, enlarged view of the linkage mechanism showing the opposite side of the mechanism from that illustrated in FIGS. 2 and 3.
Figure 10:
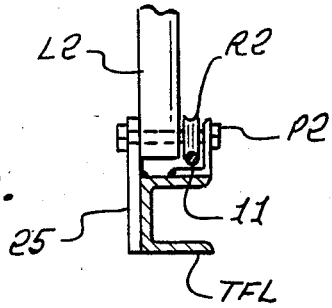
FIG. 10 is a partial, sectional view taken along the line 10—10 of FIG. 2.

The cable 11 of the cable winch system WC is coupled to the three pairs of movable links L1, L2 and L3 by means of a plurality of pulleys for controlling the position of the panel P between a substantially horizontal and a substantially vertical position. The free end of the cable 11 is unwound from the winch 21 and is placed around a pulley, identified as the pulley R2, secured by means of the fastener at the pivot point P2 for the linkage L2 on the left hand side of the frame structure T, as viewed in FIG. 2. The cable 11 is coupled to the pulley R2 underneath the pulley so that the pulley effectively acts as an idler pulley in conveying the cable 11 to and from the winch 21 (see FIG. 10). A second pulley is defined at the pivot point P1 (on the left hand side of the frame structure T) and is identified as the pulley R1. The pulley R1 is in longitudinal alignment with the pulley R2 to receive the cable 11 therearound and convey it upwardly along the top edge of the left hand link member L1, all as illustrated in FIG. 2. A third pulley is rotatably secured to the left hand link member L1 at a preselected point spaced downwardly from the pivot point P3. When the cable 11 is wound around the pulley R1 it changes the direction of the cable approximately 45 degrees, as viewed in FIG. 2 so as to be coupled around the pulley R3. The left hand link member L4T mounts a pulley R4 which is best illustrated in FIG. 6. The linkage L4T is constructed of square tubing so as to comprise the member L4T and is pivotally connected to the member L4 at pivot point P5. An L-shaped keeper bracket 40 is welded to the square tubing comprising the element L4T at the top right hand edge of the square tubing, as viewed in FIG. 6, and rotatably mounts the pulley R4 by means of a fastener 41 secured between the topmost arm of the L-shaped bracket 40 and the square tubing. The cable 11, then, as it is coupled from the pulley R3 on the link L1 is coupled to the pulley R4 on element L4. The element L4T is pivotally secured at its right hand end as viewed in FIG. 5 to a similarly arranged pulley R4'. The pulley R4' is mounted to the element L4T in the same fashion as the pulley R4 and is pivotally secured to the corresponding element L4 on the right hand side of the structure. The free end of the cable is then secured to the link L1 by means of a fastener which is identified as the point R3' (see FIG. 9). It should be noted that all of the pulleys are arranged on the left hand side of the frame T, except that the pulley R4' is symmetrically arranged relative to the pulley R4 and no pulley is provided corresponding to the pulley R3 on the right hand side of the frame. The winch cable 11, then, is coupled from the winch 21 and is conveyed to and from the winch 21 by means of the idler pulley R2 and then by means of the pulley R1. Its direction is changed from a substantially horizontal plane to an inclined plane and is coupled around the pulley R3 from which it extends to the pulleys R4 and R4' that traverse the trailer frame structure T and has its free end secured at point R3' on the linkage L1.

An important aspect of the improved apparatus of the present invention is that the pivot points for the linkage means LM have been selected to minimize the tension on cable 11 in lifting the arrow panel between the horizontal and the vertical positions. Accordingly, the pivot points identified herein have been selected for that purpose and are arranged to minimize the cable tension required to elevate the heavy traffic arrow panel P. This has been defined so that the panel P can be moved from a substantially vertical display position to a substantially horizontal position resting on the panel supporting elements 19 and 20, and vice versa. The disclosed arrangement of pivot points and pulleys is selected to uniformly lift up both halves of the symmetrical linkages without binding and with nearly identical cable motions and linkage movements occurring substantially simultaneously. The arrangement of having pairs of linkages for raising and lowering the panel P, as opposed to use of a linkage on only one side, halves the load on the cable 11 during the lifting and lowering operations.

The linkage means LM have been defined to control the lifting and lowering of the traffic message panel P between a horizontal, or transit, position, wherein the panel is at rest on the members 19 and 20 so as to extend approximately 55 inches above the supporting surface for the trailer T frame structure. In this low profile transit position the hoods for the hooded lamps HL are located immediately above the top of power source cage PS. In a vertical position, when the panel P is fully extended, the bottom of the panel will be supported by the linkage means LM a distance of approximately 84 inches above the supporting surface, as illustrated in FIG. 3.

With the above considerations, and the structural organization of the linkage means LM in mind, the pivoting of the individual pairs of links of the linkage means LM in response to the operation of the winch cable system WC will now be described in detail. It will be assumed that the panel P is in the transit storage position illustrated in FIG. 2 and will be elevated to the display position illustrated in FIG. 3. To raise the panel P, the cable 11 must be continuously shortened and for this purpose the winch arm 21H is rotated in a clockwise direction to cause the cable 11 to be wound up on the winch 21. When the winch arm 21H is so operated, the cable 11 provides a lifting force at the pivot points for the linkage means so that the cable 11 will cause the panel P to be lifted off the supporting members 19 and 20 as the linkages L1 and L2 pivot upwardly about their pivot points P1 and P2 to correspondingly cause the pair of links L3 to pivot upwardly about the pivot points P3 and P4 in being lifted in a clockwise manner to the desired display position. The continued rotation of the control arm 21H for the winch 20 will continuously shorten the cable 11 to continually cause the pairs of links L1 and L2 to assume or traverse a path that elevates them in a counterclockwise direction and, in turn, pivots the pairs of links L3 in a clockwise direction, as indicated in dotted outline in FIG. 3. In the fully vertical position illustrated in solid lines in FIG. 3, the linkage members L2 and L3 will align themselves in a side-by-side, vertical relationship in a manner illustrated in FIG. 7 (illustrated slightly displaced for emphasis). When the panel P is in a perfectly vertical position, the two links L2 and L3 will be vertically aligned. At this time, the compression springs 35 will have also moved so that the free ends thereof are seated against the sides of the link elements L2 and are seated around the seat S, as illustrated in FIG. 7. At this time, the latching bar 38 can be manually moved to secure the panel P in its vertical position by manually inserting a safety pin SP in the desired securing aperture 38A for the latch element 38. This, then, would safely secure the panel P in the desired vertical position and allow it to remain in this position, irrespective of cable breakage or movement of the winch. It should be noted that the plurality of apertures 38A provided for the latch element 38 are selected so as to permit the panel P to be positioned at preselected 10 degree increments inclined downwardly from the vertical. In terrains that are hilly, for example, it may be desirable to place the panel P at a slight incline from the vertical, so that approaching motorists will be able to better see the display panel P.

After the conditions signaled by the traffic control apparatus 10 has been remedied and there is no longer a need for the apparatus 10 at a particular job site, it can be transported to another site. Prior to transporting the trailer T to another site, the panel P is lowered to the transit position illustrated in FIG. 2. For this purpose, the winch 21 is rotated in a counterclockwise direction to pay out the cable 11 from the winch 21 as it descends. The above described manner of locating and coupling the cable 11 controllably holds the panel P in position to allow it to be continuously and smoothly lowered. With the operation of the winch 21, the cable 11 is gradually lengthened thereby gradually lowering the panel P. In descending, the pivoting action of the linkage means LM is the reverse from what has been described in elevating the panel and the weight of the panel is supported by the cable 11 as it is continuously and uniformly lowered by the operation of the winch 21. In this lowering operation, the pairs of links L1 and L2 will move downwardly in a clockwise direction to assume the positions illustrated in FIG. 2, while the links L3 traverse a counterclockwise path. As the panel P is arrested at the supporting elements 19 and 20, the tension is removed from the cable 11. When this occurs, the trailer T may be prepared for towing to another job site. For this purpose, the jacks 16 and the stabilizing elements 18 are elevated above the supporting surface so that the trailer T may be hauled by a motor vehicle to the next job site.

An important aspect of the lowering of the panel P is the function performed by the compression springs 35. As described hereinabove, the springs 35 are compressed and seated at the elements S against the linkage elements L2 when the panel P is in the elevated or substantially vertical position. Under these conditions, when the winch 21 is operated to lower the panel P, if the compression springs 35 were not present, the cable 11 would be rendered loose immediately upon operation of the winch 21 in a counterclockwise direction to pay out the cable 11 without the corresponding descent of the panel P. When a sufficient amount of cable 11 is wound on the winch 21 after this initial action, it would immediately tighten the cable 11 with the panel being tilted downwardly with a jerk which may damage the cable. The desirability of providing the compression springs 35 is that when the secured linkage elements L2 and L3 are released by removing the safety pin SP from the latch bar 38, and the panel P is in a vertical position, the energy stored in the springs 35 will move or pivot the linkages L3 downwardly and thereby move the panel P downwardly to a tilted position in which the energy of the springs 35 is expended. The springs 35 are no longer compressed when the panel P is moved to 10 to 15 degrees off of dead center. At this time, if the winch 21 is operated, the cable 11 will be in tension and will be wound uniformly on the winch 21 in response to the counterclockwise operation. This will allow the panel P to be uniformly lowered by means of the winch 21.

Another important feature of the present invention is the provision for the pivoting of the cross member L4T relative to the cross members L4 as the panel P is raised and lowered. The cross member L4T is free to rotate about the pivot points P5. With the operation of the winch 21, for example, to elevate the panel P, the tension on the cable 11 at the pulleys R4 and R4' will cause the arm L4T to rotate about the pivot points P5 to prevent the side loading on the pulleys R4 and R4' adjacent the end of the upward travel of the panel P. This simple expedient will minimize the stresses on the flanges for loading of the pulleys R4 and R4' and any damage thereto, or prevent the cable from jumping off the pulleys. This same pivoting action occurs during the lowering of the panel P.

A further advantage of the linkage means LM is taken advantage of in the lifting operations on the panel P. During these intervals as the panel approximates a vertical position, the pair of links L2 carrying the cross member L2T will engage the links L3 so that the member L2T functions as a positive stop for the upward or vertical position of the linkages L3 and thereby the panel P.

Now referring to FIGS. 11 and 12, the method of stacking the traffic control apparatus 10 will be described. The method of stacking permits the trailer frame structures T to be stacked, one on top of another, for shipment, without the need to dismantle the linkage means LM and associated winch-cable system WC, as in known prior art techniques. As in the prior art, the traffic display panel P is released from the linkage means LM and shipped in a separate container. Also, the yoke Y is removed, if fully assembled at the manufacturing site, and shipped separately. The low profile of the traffic control apparatus 10 allows a larger number of the apparatus 10 to be stored and shipped in a container such as a truck/ trailer for a given trailer size, as will become evident.

Assuming the panel P and the yoke Y have been removed from the apparatus 10, the apparatus 10 is prepared for stacking and shipment from the manufacturing plant. To permit the bulky apparatus 10 to assume a lower profile than the one illustrated in FIG. 2, one of the traffic control apparatus 10 has its pivot point P1 changed for purposes of shipment only. This lower traffic control apparatus is identified in FIG. 11 as the apparatus 10L, while the upper apparatus is identified as the apparatus 10T. The upper apparatus 10T is not so modified, as is evident from examining FIG. 11. To this end, the plate 24 for the apparatus 10L is noted as providing a further pivot point identified as the point 50 on the plate 24. The linkage elements L1 on the two sides of the apparatus 10L are moved forwardly to assume the pivot position 50 from the pivot positions P1, which moves the entire linkage means LM forward and downward, as illustrated in FIG. 11. The differences in the vertical profile can be noted from examining FIG. 11 since the topmost apparatus 10T is arranged at the normal operating pivot point P1.

The apparatus 10L and 10T are stacked by supporting the apparatus 10T over the apparatus 10L through the provision of stacking members SM which are secured to the trailer frame T at the longitudinally extending elements TL forward and reverse of the wheel assemblies TWL and TWR on both sides of the trailer frame structures T. The stacking members SM are provided with mounting blocks MB to interfit with the elements TL of the lower apparatus 10L as illustrated in FIGS. 11 and 12. A single mounting, block MB may be employed underneath the frame members TFL and TFR for the top apparatus 10T. The stacking members SM are secured to the frame members TFL and TFR by means of suitable fasteners 51. Suitable cross members may also be employed to prevent lateral sway of the apparatus during shipment. The apparatus 10L and 10T stacked in this manner can be readily moved into a truck/trailer for shipment.

With the above described stacked arrangement it has been found that twelve of the traffic control apparatus 10 can be stacked in a closed, 40 foot long truck, versus ten such prior art type apparatus in a similar truck (where the prior art type apparatus requires that linkage means be disassembled before stacking).

At the point of use, the apparatus 10L and 10T can be unstacked by removing the stacking members SM. The apparatus 10T is ready to receive a panel and a yoke Y without any further adjustments. The lower apparatus 10L must have the links L1 moved back to the pivot points P2 from the stacking pivot point 50. The panel P can be readily lifted and rested on the power source cage PS to permit the linkage means L3 to be secured to the panel by means of three fasteners 30, 31 and 32. It should also be noted that the panel P can be readily detached from the linkages L3 by removing the same three fasteners. This can be done while the panel P is resting on the support members 19 and 20. The yoke Y, then, may be secured to its brackets to the trailer frame structure T and the trailer frames will then be ready for use on the highway or the like.

In a specific embodiment of the described traffic control apparatus, the pivot points that have been selected to minimize the tension on cable 11 in lifting the arrow panel are defined with reference to FIG. 2 as follows:

The longitudinal distance between pivot points P1 and P2 is $48\frac{3}{8}$ inches.

The distance between P2 and P4 on L2 is $41\frac{3}{4}$ inches.

The distance between P3 and P4 on L3 is $11\frac{1}{2}$ inches.

The distance between P1 and P3 on L1 is $71\frac{3}{4}$ inches.

The distance between P1 and R3 on L1 is $55\frac{1}{2}$ inches.

The vertical distance between P4 and P5 is 13 inches with the horizontal distance between P4 and P5 being 6 inches.

I claim:

1. A traffic controller comprising a supporting frame structure, dual symmetrically arranged linkage means pivotally secured to the frame structure for movement relative to the supporting frame structure, arrow display means secured to said linkage means to be responsive to the movements thereof to move between substantially vertical and substantailly horizontal positions, control means coupled to said linkage means for uniformly moving said linkage means to selectively move the arrow display means between said positions and maintain the display means in a preselected position, and compression spring means carried by said linkage means to engage the linkage means and to be compressively seated thereto when the linkage means are moved to place the display means in a preselected display position at or adjacent said vertical position, the compression spring means automatically functions to move the display means a preselected distance away from said preselected position when the securing means is released and prior to when the linkage means are controllably moved away from said preselected display position.

2. A traffic controller comprising a supporting frame structure, dual, symmetrically arranged linkage means pivotally secured to the frame structure for movement relative to the supporting frame structure, arrow display means secured to said linkage means to be responsive to the movements thereof to move between substantially vertical and substantially horizontal positions, control means coupled to said linkage means for uniformly moving said linkage means to selectively move the arrow display means between said positions and maintain the display means in a preselcted position, means for securing the linkage means and thereby the display means in a preselected display position independently of the control means, and compression spring means carried by said linkage means to engage the linkage means and to be compressively seated thereto when the linkage means are moved to place the display means in a preselected display position at or adjacent said vertical position, the compression spring means automatically functions to move tbe display means a preselected distance away from said preselected position when the securing means is released and prior to when the linkage means are controllably moved away from said preselected display position.

3. A portable traffic controller comprising a supporting frame struture of the wheeled trailer type, a plurality of pairs of bar linkage means pivotally and symmetrically secured to the supporting frame for movement relative to the supporting frame, said pairs of linkage means including a first pair of bar linkage means pivotally and symmertrically secured adjacent one end of the likages to the opposite sides of the supporting frame adjacent one end of the frame, means secured to said first bar linkage means for causing them to move in unison when pivoted relative to the frame, a second pair of bar linkage means pivotally and symmetrically secured adjacent one end of the linkage means to the opposite sides of the supporting frame at preselected points spaced on the frame from said first pair of bar linkage means, means secured to said second bar linkage means for causing them to move in unison when pivoted relative to the frame, a third pair of bar linkage means pivotally and symmetrically secured adjacent one end thereof to both said first and second pairs of linkage means, said first pair of linkage means being pivotally connected to said third pair of linkage means at preselected pivot points spaced from said one end of said third pair of linkage means, said second pair of linkage means being pivotally connected to said third pair of linkage means at pivot points spaced intermediate said one end of said third pair of linkage means and the pivot points of said first pair of linkage means, traffic control arrow display means secured to the remaining free ends of the third pair of linkages to be moved in unison with the movements of said third pair of linkage means, and linkage control means secured to the frame structure and coupled to said pairs of bar linkage means for applying forces thereto for uniformly controlling the movements of each of said pairs of linkage means to electively position the said display means between an arrow display position and a display means storage position on the supporting structure, said display position comprises a substantially vertical display position and preselected angular positions spaced preselected angular increments from a vertical position and said display means storage position comprises a substantially horizontal storage position, the supporting frame structure including supporting means secured to the frame means adjacent one end thereof and extending outwardly a preselected distance to arrest the travel to the display means at a substantially horizontal storage position with said display means resting on said supporting means.

4. A traffic controller comprising a supporting frame structure, symmetrically aranged four pairs of bar linkage means having two pairs of the linkage means pivotally secured to the opposite sides of the frame structure with the frame structure functioning as one of said four pair of bar linkage means, the two pairs of linkage means being secured to preselected longitudinally spaced points on the frame structure with each pair being symmetrically arranged on opposite sides of the frame structure, the remaining pair of linkage means being pivotally connected to each of said two pairs of linkage means at spaced, preselected positions adjacent one end of the remaining pair of linkage means to cause said remaining pair of linkage means to be moved between a substantially horizontal and a substantially vertical position in response to the pivotable movements of said two pairs of linkage means, arrow display panel means secured to the opposite end of said remaining pair of linkage means to be pivotable therewith, and linkage control means secured to the frame structure and coupled to said linkage means for controlling the positions of the said two pair of linkage means to selectively position the remaining pair of linkage means and thereby arrow display panel means carried therewith between an arrow display position and a panel storage position, the operation of the linkage control means causes said display panel means to be substantailly simulataneously elevated and rotated from a substantially horizontal position to a substantailly vertical position or to be substantially simultaneously lowered and rotated from a substantilly vertical position to a substantially horizontal position.

5. A method of stacking portable traffic control trailers for shipment in a container or the like, including the steps of providing a supporting frame structure of the wheeled trailer type for traffic control display apparatus, pivotally securing a plurality of linkages to the supporting frame for controlling the position of traffic control apparatus between a traffic control display position and a storage position on the supporting frame, releasably securing traffic control display apparatus to said bar linkages to be responsive to the controlled movements of the bar linkages between a substantially vertical traffic control display position and a preselected horizontal position, controlling the linkages to cause the display apparatus to be moved to said preselected horizontal position, releasing the traffic control display apparatus from said linkages and removing same from the supporting frame after the traffic control apparatus has been placed in said preselected horizontal position, changing the pivot point position of at least one of said plurality of linkages to cause the linkages to assume a lower vertical position than when in said preselected horizontal position, repeating each of the above steps for a second portable traffic control trailer, except the last mentioned step, and mounting said second portable traffic control trailer over the top of the first portable traffic control trailer.

6. A method of stacking as defined in claim 5 including the steps of securing the thus stacked portable traffic control trailers together to prevent relative movement between the trailers, and moving the stacked and secured trailers into a shipping compartment to be shipped thereby in said stacked position.

7. A portable traffic controller comprising a supporting frame structure of the wheeled trailer type, a plurality of pairs of bar linkage means pivotally and symmetrically secured to the supporting frame for movement relative to the supporting frame, said pairs of linkage means including a first pair of bar linkage means pivotally and symmetrically secured adjacent one end of the linkaages to the opposite sides of the supporting frame adjacent one end of the frame, means secured to said first bar linkage means for causing them to move in unison when pivoted relative to the frame, a second pair of bar linkage means pivotally and symmetrically secured adjacent one end of the second pair of bar linkage means to the opposite sides of the supporting frame at preselected points longitudinally spaced on the frame from said first pair of bar linkage means, means secured to said second bar linkage means for causing them to move in unison when pivoted relative to the frame, a third pair of bar linkage means pivotally and symmetrically secured in spaced relationship adjacent one end thereof to both said first and second pairs of linkage means, said first pair of linkage means being pivotally connected to said third pair of linkage means at preselected pivot points spaced from said one end of said third pair of linkage means, said second pair of linkage means being pivotally connected to said third pair of linkage means at pivot points spaced intermediate said one end of said third pair of linkage means and the pivot points of said first pair of linkage means, traffic control arrow display means secured to the remaining free ends of the third pair of linkages to be moved in unison with the movements of said third pair of linkage means, and linkage control means secured to the frame structure and coupled to said pairs of bar linkage means for evenly applying forces to both sides of the linkage means for uniformly controlling the movements of each of said pairs of linkage means to selectively position the said display means between an arrow display position and a display means storage position on the supporting frame structure, the movements of the said pairs of linkage means causing said display means to be simultaneously elevated and rotated from a substantially horizontal position to a substantially vertical position or to be substantially simultaneously lowered and rotated from a substantially vertical position to a substantially horizontal position.

8. A portable traffic controller as defined in claim 7 including manual safety control means for securing said second and third pair of linkages to a preselected message display position.

9. A portable traffic controller as defined in claim 7 wherein said linkage control means comprises a winch-cable system having a single cable.

10. A portable traffic controller comprising a supporting frame structure of the wheeled trailer type, a plurality of pairs of bar linkage means pivotally and symmetrically secured to the supporting frame for movement relative to the supporting frame, said pairs of linkage means including a first pair of bar linkage means pivotally and symmetrically secured adjacent one end of the linkages to the opposite sides of the supporting frame adjacent one end of the frame, means secured to said first bar linkage means for causing them to move in unison when pivoted relative to the frame, a second pair of bar linkage means pivotally and symetrically secured adjacent one end of the linkage means to the opposite sides of the supporting frame at preselected points spaced on the frame from said first pair of bar linkage means, means secured to said second bar linkage means for causing them to move in unison when pivoted relative to the frame, a third pair of bar linkage means pivotally and symmetrically secured adjacent one end thereof to both said first and second pairs of linkage means, said first pair of linkage means being pivotally connected to said third pair of linkage means at preselected pivot points spaced from said one end of said third pair of linkage means, said second pair of linkage means being pivotally connected to said third pair of linkage means at pivot points spaced intermediate said one end of said third pair of linkage means and the pivot points of said first pair of linkage means, traffic control arrow display means secured to the remaining free ends of the third pair of linkages to be moved in unison with the movements of said third pair of linkage means, linkage control means secured to the frame structure and coupled to said pairs of bar linkage means for applying forces thereto for uniformly controlling the movements of each of said pairs of linkage means to selectively position the said display means between an arrow display position and a display means storage position on the supporting frame structure, said display position comprises a substantially vertical display position and preselcted angular positions spaced preselected angular increments from a vertical position and said display means storage position comprises a substantially horizontal storage position, the supporting frame structure including supporting means secured to the frame means adjacent one end thereof and extending outwardly a preselected distance to arrest the travel of the display means at a substantially horizontal storage position with said display means resting on said supporting means, and manual safety control means for securing said second and third pair of linkages to a preselected message display position.

11. A portable traffic controller comprising a supporting frame structure of the wheeled trailer type, a plurality of pairs of bar linkage means pivotally secured to the supporting frame for movement relative to the supporting frame, said plurality of pairs of bar linkage means comprising a first pair of bar linkage means symmetrically arranged on opposite sides of the supporting frame and each being pivotally secured to the frame adjacent one end thereof to move in unison in response to a pivoting force being imparted thereto, a second pair of bar linkage means symmetrically arranged on opposite sides of the supporting frame and each being pivotally secured to the frame adjacent one end thereof and at a preselected location spaced from said one end of the frame to move in unison in response to a pivoting force being imparted thereto, and a third pair of bar linkage means symmetrically arranged with said first and second pair of bar linkage means and being pivotally secured to each of said pairs of linkage means adjacent one end thereof to be pivoted in unison in response to the pivoting forces imparted to said first and second pair of bar linkage means, traffic control display apparatus secured to the other end of said third pair of bar linkage means to be moved in unison therewith, said third pair of bar linkage means including a cross member pivotally secured adjacent said one end thereof, and a controllable winch-cable system secured to the frame and having the cable coupled from the winch to said plurality of pairs of bar linkage means for imparting a pivoting force thereto in response to the alternate rotations of the winch causing the shortening and lengthening of the length of cable payed out from the winch to uniformly move the traffic control display apparatus between a substantially vertical display position and a substantially horizontal storage/transit position, said winch-cable system including a plurality of pulleys spaced on said bar linkage means including a first rotatable pulley secured adjacent the pivot point for said second pair of bar linkage means on the same side of the frame as said winch-cable system for conveying the cable to and from the winch, a second rotatable pulley secured adjacent the pivot point for said first pair of bar linkage means on said same side of the frame for conveying the cable to and from said first rotatable pulley, a third rotatable pulley secured to said first pair of bar linkage means at a preselected spaced location on one of the bars of said first pair of linkage means from said second pulley and on the same side of the frame as said second pulley to convey the cable to and from said second pulley, a pair of rotatable pulleys rotatably secured adjacent each end of said cross member to move in unison therewith, one of said pair of rotatable pulleys being positioned to convey the cable to and from said third rotatable pulley and to and from the other pulley on said cross member, the cable being conveyed from said other pulley to be fixedly secured to said other one of the bars of said first pair of linkage means on the opposite side of the frame, the operation of the winch-cable system controls the length of the cable extending from the winch causing the responsive rotation of said cross member to thereby minimize the loading stresses at said pair of pulleys secured to said cross members during the operation of the winch-cable system.

12. A portable traffic controller as defined in claim 11 including a pair of upstanding members secured to said frame structure adjacent the pivot points for said first pair of bar linkages and having a preselected length extending upwardly from said frame structure to receive and arrest the downward travel of the traffic control apparatus for defining a storage position therefor on said frame structure.

13. A portable traffic controller as defined in claim 11 including compression spring means secured at one end thereof and adjacent the ends of said third pair of bar linkage means so as to extend outwardly therefrom, a pair of apertured plates secured at one end of the opposite sides of said third pair of bar linkage means adjacent said spring means, the operation of the winch-cable system to place the traffic control apparatus in said display position causing the spring means to be compressed and seated against each of the bar linkages for said second pair of bar linkage means, each of said bar linkages for said second pair of bar linkages having a linkage securing aperture provided thereon and spaced adjacent the spring seating position to permit the apertured plates to be secured thereto by means of a securing pin positioned through the aligned apertures for said plates and said bar linkages to secure the display apparatus in said display position independently of the winch-cable system, the release of the securing pins from said apertured plates causing the expansion of said spring means to thereby move the third pair of bar linkage means away from the second pair of bar linkage means to thereby cause the display apparatus to be moved in a downward direction from said display position in preparation for the downward movement thereof by the operation of the winch-cable system.

14. A portable traffic controller as defined in claim 13 wherein said securing pins are each loosely carried by the individual bar linkages to permit the pins to be positioned through said aligned apertures, said apertured plates being further characterized as each having a plurality of spaced apart apertures for securing the display apparatus in a selected vertical display position and a plurality of preselected angular positions spaced downwardly from said vertical display position.

15. A portable traffic controller as defined in claim 14 including retractable means for stabilizing the supporting frame structure relative to its supporting surface.

16. A portable traffic controller as defined in claim 13 wherein said bar linkages for said second pair of bar linkage means includes means constructed and defined thereon at a preselected location for seating the ends of the compression springs.

17. A portable traffic controller as defined in claim 11 wherein the pivot points for said pair of bar linkage means are preselected for minimizing the tension on the winch cable when the winch-cable system is operated to lift the display apparatus to said display position.

18. A portable traffic controller as defined in claim 11 wherein the thus defined pulley-cable system causes the load on the cable to be substantially halved as a result of the forces being transmitted through each pair of said linkage means.

19. A portable traffic controller as defined in claim 11 wherein said second pair of bar linkage means includes a cross member secured to the bar linkage means on opposite sides of the supporting frame to cause said means to move in unison, said cross member being positioned for engaging said third pair of bar linkage means when the winch-cable system is operated to place the display apparatus in a substantially vertical position to thereby positively arrest the upward movement of said third pair of bar linkage means.

20. A portable traffic controller comprising a supporting frame structure of the wheeled trailer type, a plurality of pairs of bar linkage means pivotally and symmetrically secured to the supporting frame for movements relative to the supporting frame, said linkage means including a first pair of bar linkage means pivotally and symmetrically secured adjacent one end of the linkages to the opposite sides of the supporting frame adjacent one end of the frame, means secured to said first bar linkage means for causing them to move in unison when pivoted relative to the frame, a second pair of bar linkage means pivotally and symmetrically secured adjacent one end of the linkage means to the opposite sides of the supporting frame at a preselected point spaced on the frame from said first pair of bar linkage means, means secured to said second bar linkage means for causing them to move in unison when pivoted relative to the frame, a third pair of bar linkage means pivotally and symmetrically secured adjacent one end thereof to both said first and second pairs of linkage means, said first pair of linkage means being pivotally connected to said third pair of linkage means at preselected pivot points spaced from said one end of said third pair of linkage means, said second pair of linkage means being pivotally connected to said third pair of linkage means at pivot points spaced intermediate said one end of said third pair of linkage means and the pivot points for said first pair of linkage means, traffic control arrow display means secured to the remaining free ends of the third pair of linkage means to be moved in unison with the movements of said third pair of linkage means, a fourth pair of bar linkage means secured to each bar linkage of said third pair of bar linkage means adjacent the ends opposite the ends securing the display means, bar means pivotally secured to each of the pair of bar linkages of said fourth pair of linkage means, linkage control means secured to the frame structure at a preselected position spaced from said frame pivot for said second pair of bar linkage means on the opposite side from said first pair of bar linkage means, said control means comprising winch means secured to one side of the frame structure for controlling said pairs of linkage means through a winch cable having one end secured to the winch means, said linkage control means including first pulley means rotatably secured to the frame means adjacent the pivot point for one of said bar linkages of said second pair of linkage means to convey the winch cable to and from the winch means, second pulley means rotatably secured to the frame means adjacent the pivot point for one of said bar linkages of said first pair of linkage means for conveying the winch cable to and from the first pulley means, third pulley means rotatably secured to said one bar linkage of said first pair of bar linkage means a preselected distance spaced from the second pulley means for conveying the winch cable to and from said second pulley means, fourth and fifth pulley means rotatably secured to said bar means adjacent each end thereof for conveying the winch cable to the opposite side of the supporting frame from said winch means by means of said fourth and fifth pulley means, the winch cable having its free end secured to the adjacent bar linkage of said first pair of bar linkage means on said opposite side of the supporting frame at a point corresponding to the position of said third pulley means whereby the winch cable symmetrically transmits the pivoting forces to said pairs of bar linkage means in accordance with the direction of rotation of the winch means for controlling the movements of the arrow display means between a substantially vertical display position and a substantially horizontal storage position.

21. A method of setting up a portable traffic control trailer shipped separately from a traffic control display panel including the steps of receiving a supporting frame structure of the wheeled trailer type for use with a traffic control display panel, the supporting frame having a plurality of controllable linkages pivotally secured to the supporting frame and adapted for mounting a traffic control display panel, one of the plurality of linkages being pivoted to the supporting frame at a shipping position, changing the pivot position of said one of the plurality of linkages to position it in an operative pivoting position with the remaining linkages corresponding to the storage position of the traffic control display panel on said frame to permit the linkages to be controllably moved, securing a traffic control display panel at said storage position to said plurality of linkages to permit the panel to be controllably raised and lowered by means of the linkages, moving the thus assembled traffic control trailer to a preselected position for controlling traffic on a highway or the like, stabilizing the traffic control trailer at said preselected traffic control position, and controllably operating the linkages to raise the traffic control display panel to a traffic display position for controlling traffic.

22. A method of controlling the position of traffic control apparatus between a display position and a storage position mounted on a supporting frame structure of the wheeled trailer type, including the steps of providing four pairs of bar linkages constructed and defined to move traffic control apparatus uniformly between a traffic display position and a storage position and vice versa, designating one of the pair of linkages as the frame structure of the wheeled trailer, selecting the locations of the pivot points for the four pairs of bar linkages to minimize cable tension in lifting the traffic control apparatus, pivotally securing two pairs of bar linkages at longitudinally spaced points on the frame structure at said selected positions, pivotally securing the fourth pair of bar linkages to said latter mentioned two pairs of bar linkages at said selected locations, mounting traffic control apparatus to said fourth pair of bar linkages to be movable therewith, providing a winch-cable apparatus having a single cable coupled to said pairs of bar linkages to enable the pivotal lifting and lowering of the pairs of bar linkages relative to the frame structure by the alternate rotation of the winch for controlling the length of a single cable extending outwardly therefrom, and selecting the locations for coupling the winch cable on said pairs of bar linkages so as to smoothly pivot each pair of bar linkages from both sides of the pairs of linkages in response to the rotation of the winch to place substantially half of the load on the single winch cable while substantially smoothly raising and lowering the traffic control apparatus by means of the winch-cable apparatus to cause the traffic control apparatus to be simultaneously rotated and elevated in raising the traffic control apparatus or to be simultaneously rotated and lowered in lowering the traffic control apparatus.

23. A method of controlling the position of traffic control display apparatus including the steps of mounting traffic control display apparatus on controllable linkage means to permit the display apparatus to be controllably moved between a substantially vertical position and a substantially horizontal position, coupling linkage control means to the linkage means in a controllably operative relationship therewith to permit the linkage means to controllably move in response to the operation of the control means to thereby cause the display apparatus to be uniformly moved between preselected display positions for the display apparatus and a storage position spaced from the display position under the control of the control means, operating the control means to position the display apparatus between a preselected substantially vertical display position and a preselected substantially horizontal position, manually securing the display appparatus at a preselected display position to hold the display apparatus at the selected display position independently of the linkage control means, manually releasing the secured display apparatus in preparation for changing the position thereof, and automatically moving the display apparatus downwardly from its preselected display position in respose to the release of the display apparatus and prior to operating the control means.

24. A method of controlling the position of traffic control display apparatus as defined in claim 23 including the steps of providing a support for arresting the downward travel of display apparatus in response to the operation of the control means for moving the display apparatus to a substantially horizontal position, and arresting the downward travel of the display apparatus at said support for supporting the display apparatus in a preselected substantially horizontal position while operating the control means to lower the display apparatus for maintaining the display apparatus at said preselected position and thereby render the control means disabled for lowering the display apparatus further/and yet capable of being responsive to the operation of the control means to raise the display apparatus from said pre.-selected position.

25. A method of controlling the position of traffic control display apparatus as defined in claim 24 including the step of securing the controllable linkage means and the linkage control means to a supporting frame structure of the wheeled trailer type.

26. A method of controlling the position of traffic control display apparatus including the steps of mounting traffic control display apparatus on controllable linkage means to permit the display apparatus to be controllably moved between a substantially vertical position and a substantially horizontal position, coupling linkage control means to the linkage means in a controllably operative relationship therewith to permit the linkage means to controllably move in response to the operation of the control means to thereby cause the display apparatus to be uniformly moved between preselected display positions for the display apparatus and a storage position spaced from the display position under the control of the control means, operating the control means to position the display apparatus between a preselected substantially vertical display position and a preselected substantially horizontal position, manually releasing the secured display apparatus in preparation for changing the position thereof, and automatically moving the display apparatus downwardly from its preselected display position in response to the release of the display apparatus and prior to operating the control means.

* * * * *

UNITED STATES PATENT AND TRADEMARK OFFICE

CERTIFICATE OF CORRECTION

PATENT NO. : 4,593,265

DATED : June 3, 1986

INVENTOR(S) : John D. McKenney

It is certified that error appears in the above-identified patent and that said Letters Patent is hereby corrected as shown below:

IN THE SPECIFICATION:

Column 7, line 36, change "oreselected" to -- preselected --
Column 8, line 61, after "springs" add -- 35 --

IN THE CLAIMS

Column 13, line 53, change "substantailly" to -- substantially -
Column 14, lines 59 and 60 , change "electively" to
-- selectively --
Column 15, line 2, change "to" (2nd occurrence) to -- of --
Column 15, line 31, change "substantailly" to --substantially --.
Column 15, line 33 , change "substantailly" to -- substantially -
Column 15, line 35, change "substantilly" to -- substantially --
Column 16, line 8, change "linkaages" to -- linkages --
Column 22, line 2, change "respose" to -- response --

Signed and Sealed this

Twenty-eighth Day of October, 1986

[SEAL]

*Attest:*

DONALD J. QUIGG

*Attesting Officer* *Commissioner of Patents and Trademarks*